United States Patent [19]

Nakamura

[11] Patent Number: 4,986,249

[45] Date of Patent: Jan. 22, 1991

[54] IGNITION APPARATUS MOUNTING STRUCTURE FOR INTERNAL COMBUSTION ENGINE

[75] Inventor: Akihide Nakamura, Yokohama, Japan

[73] Assignee: Nissan Motor Co., Ltd., Yokohama, Japan

[21] Appl. No.: 413,302

[22] Filed: Sep. 27, 1989

[30] Foreign Application Priority Data

Oct. 12, 1988 [JP] Japan ..... 63-133127[U]

[51] Int. Cl.[5] ..... F02P 3/02

[52] U.S. Cl. ..... 123/635; 123/52 M

[58] Field of Search ..... 123/635, 634, 169 PA, 123/647, 643, 52 M, 52 MV, 52 MC

[56] References Cited

U.S. PATENT DOCUMENTS

| | | | |
|---|---|---|---|
| 2,974,654 | 3/1961 | Bouvy | 123/52 MV |
| 3,792,694 | 2/1974 | Brenholts | 123/635 |
| 4,461,264 | 7/1984 | Iwasaki | 123/635 |
| 4,484,549 | 11/1984 | Yokoyama | 123/52 M |

FOREIGN PATENT DOCUMENTS

| | | | |
|---|---|---|---|
| 59-226274 | 12/1984 | Japan | 123/635 |
| 60-66877 | 5/1985 | Japan . | |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

To facilitate inspection of ignition coils and ignition plugs without removing intake pipes from the cylinder head, while preventing the ignition coils from being heated by the cylinder head, in V-shape internal combustion engine, plural intake pipes branched from two air collectors are each arranged so as to extend above the cylinder head and across the cylinder line and further being offset away from over each ignition plug, and further plural ignition coils are each arranged over and connected to ignition plugs, respectively. The ignition coils are supported by two opposing support members formed on two outer side surfaces of two adjacent intake pipes.

2 Claims, 3 Drawing Sheets

IGNITION APPARATUS MOUNTING STRUCTURE FOR INTERNAL COMBUSTION ENGINE

BACKGROUND OF THE INVENTION

1. Field of the Invention

The present invention relates generally to an ignition apparatus mounting structure for an internal combustion engine, and more specifically to an ignition apparatus mounting structure which can improve inspection work efficiency and ignition coil performance.

2. Description of the Prior Art

As an example of ignition apparatus for internal combustion engines, Japanese Published Unexamined (Kokai) Utility Model Application No. 60-66877 discloses an ignition apparatus, in which a plurality of ignition plugs 2 are provided, respectively for engine cylinders formed within a cylinder head 1 and further each ignition coil 3 is arranged just over the ignition plug 2 to supply a high tension (voltage) to each ignition plug 2. In the prior-art ignition apparatus of this type, since the length of each high tension cord 4 connecting the ignition coil 3 to the ignition plug 2 can be minimized, there exists such an advantage that it is possible to minimize electric wave noise generated from the high tension cords 4.

In the structure of the prior-art ignition apparatus the ignition coils 3 are arranged near and over the ignition plugs 2. However, there exists another problem in that inspection work efficiency of the ignition coils 3 and the ignition plugs 2 is very low according to the arrangement of the intake system. In more detail, in the case of a V-shaped engine where two right and left cylinder lines are arranged so as to form two predetermined banks (swollen portions), since each intake pipe branched from an intake air collector and connected to each engine cylinder is arranged over the cylinder head and across the cylinder line and therefore the ignition coils 3 and the ignition plugs 2 are arranged under an intake pipe, it is impossible to inspect the ignition coils 3 and the ignition plugs 2 without removing the intake pipes from the cylinder head 1, thus reducing the inspection work efficiency of the ignition apparatus. In addition, since the ignition coils 3 are arranged on the cylinder head 1, the ignition coils 3 are subjected to the influence of heat generated from the cylinder head 1, so that the high tension generated from the ignition coils 3 often drops.

SUMMARY OF THE INVENTION

With these problems in mind, therefore, it is the primary object of the present invention to provide an ignition apparatus mounting structure for an internal combustion engine, which is easy to inspect both the ignition coils and the ignition plugs without removing the intake pipes from the cylinder head, while preventing the ignition coils from being heated by the cylinder head.

To achieve the above-mentioned object, an ignition apparatus mounting structure for an internal combustion engine, according to the present invention, having at least one cylinder head (10) formed with a plurality of engine cylinders; a plurality of ignition plugs (45) provided for the engine cylinders, respectively; a plurality of ignition coils (30) connected to the ignition plugs, respectively; and a plurality of intake pipes (24) branched from at least one air collector (22) and connected to the engine cylinders, respectively wherein each of said intake pipes is arranged extending above said cylinder head and across a cylinder line and being offset and away from over each of said ignition plugs, and further each of said ignition coils is arranged over and connected to one of said ignition plugs.

Further, each intake pipe is formed with two support members (26) on both outer side surfaces thereof, and each ignition coil is supported by the two opposing support members formed on the two adjacent intake pipes.

In the ignition apparatus mounting structure for an internal combustion engine according to the present invention, since each intake pipe extending above the cylinder head and across the cylinder line is offset away from over the ignition plug, and further the ignition coil is arranged over and connected to the ignition plug, it is possible to inspect the ignition coils and the ignition plugs without removing the intake pipes from the cylinder head. Further, since the ignition coil is supported between the two adjacent intake pipes via the two opposing support members, it is possible to prevent the ignition coil from being directly heated by the cylinder head.

DETAILED DESCRIPTION OF THE EMBODIMENT

Figure 1:
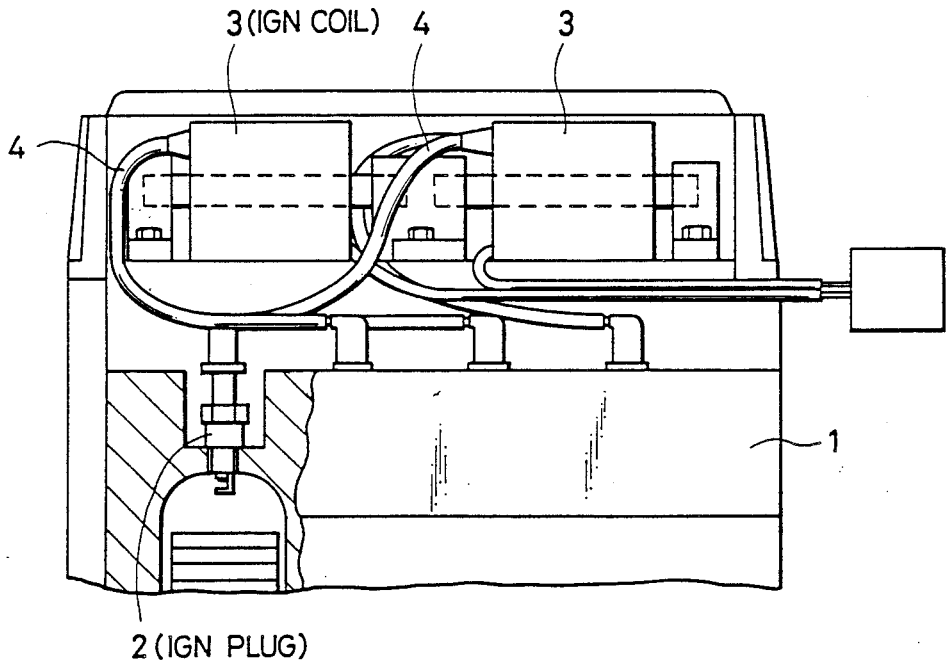
FIG. 1 is a partially cross-sectional, side view for assistance in explaining a prior-art ignition apparatus mounting structure for an internal combustion engine.
Figure 2:
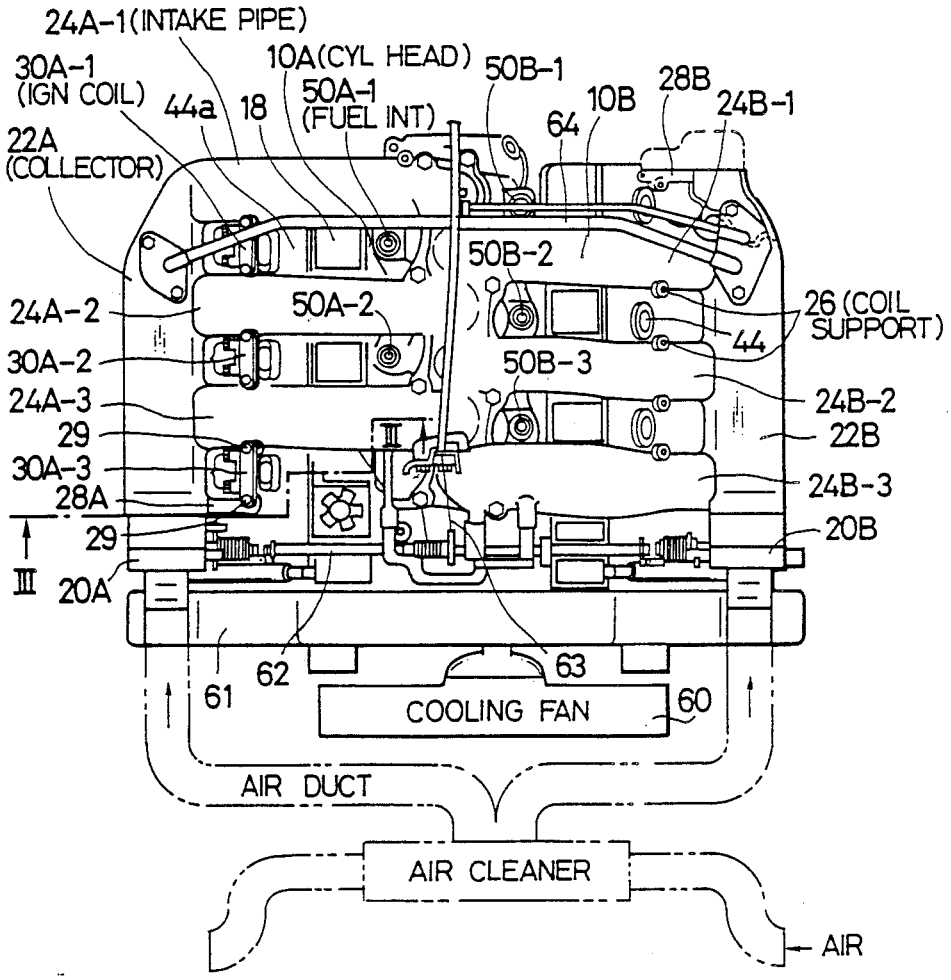
FIG. 2 is a top view showing an ignition apparatus mounting structure for an internal combustion engine according to the present invention.
Figure 3:
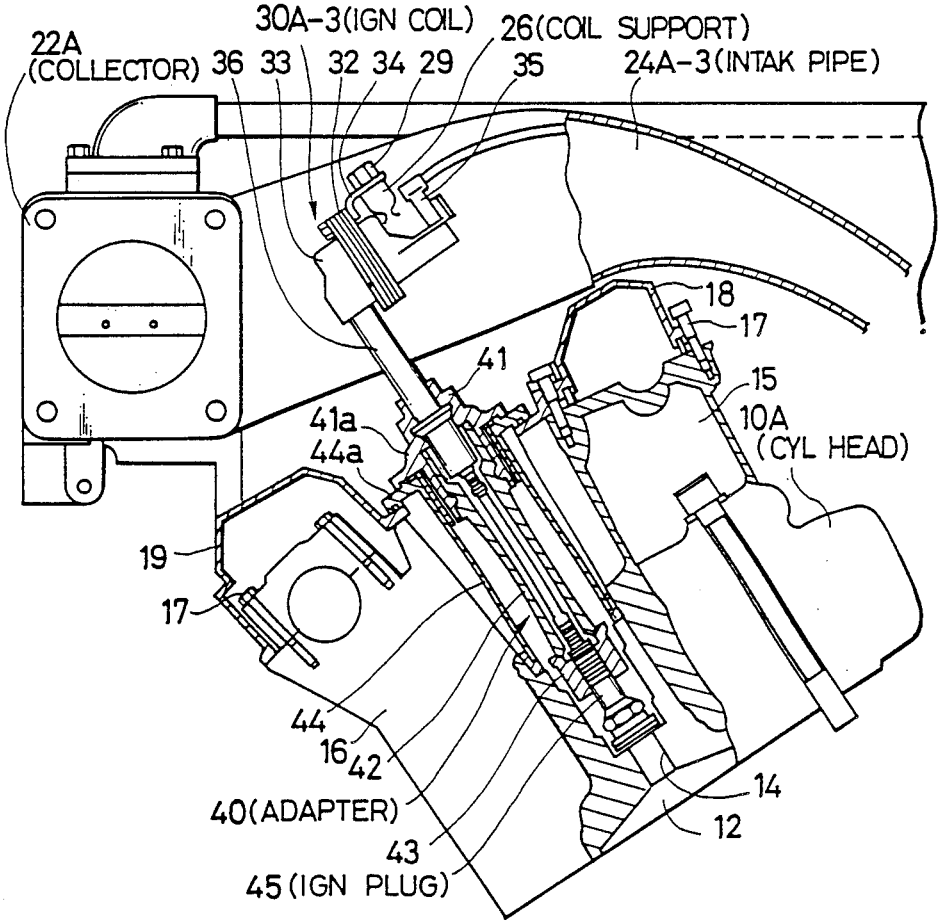
FIG. 3 is a cross-sectional view taken along the broken line III—III in FIG. 2.

An embodiment of the ignition apparatus mounting structure according to the present invention will be described hereinbelow with reference to the attached drawings. FIGS. 2 and 3 show a V-shape six-cylinder engine of two cylinder lines with predetermined banks, to which the present invention is applied, by way of example.

In FIG. 2, the engine includes a left side cylinder head 10A and a right side cylinder head 10B. On the left side cylinder head 10A, there are arranged a left side intake air system composed of a throttle chamber 20A arranged near a corner of the cylinder head 10A and connected to an air cleaner through an air duct, an air collector 22A arranged on the outside edge of the cylinder head 10A along the cylinder line direction and connected to the throttle chamber 20A, and three intake pipes 24A-1, 24A-2 and 24A-3 branched from the air collector 22A and connected to three intake ports of three engine cylinders, respectively. Further, three ignition coils 30A-1, 30A-2 and 30A-3 and three fuel injection valves 50A-1, 50A-2 and 50A-3 (not shown) are also arranged for three engine cylinders, respectively on the left side cylinder head 10A.

In quite the same way, on the right side cylinder head 10B, there are arranged a right side intake air system composed of a throttle chamber 20B, an air collector 22B, and three intake pipes 24B-1, 24B-2 and 24B-3, three ignition coils 30B (not shown but three protective cylindrical member 44 of high tension adapters 40 are shown), and three fuel injection valves 50B-1, 50B-2, and 50B-3.

Further, in FIG. 2, the engine includes a cooling fan 60, a front cover 61, a common throttle actuating shaft 62 for actuating throttle valves disposed within the throttle chambers 20A and 20B, a wire 63 for rotating the common throttle actuating shaft 62, an idle intake pipe 64 for distributing intake air supplied by an air regulator (not shown) into the two air collectors 22A and 22B, etc.

With reference to FIG. 3, an ignition plug hole 14 (to which an ignition plug 45 is fitted) is formed in the cylinder head 10A (on the left side) at the central upper portion of a combustion chamber 12 of each cylinder. In the cylinder head 10A, two valve actuation chambers 15 and 16 within which a cam shaft (not shown) for actuating an intake valve and an exhaust valve, respectively are housed over an intake port and an exhaust port (both not shown) communicating with the combustion chamber 12, respectively. These valve actuation chambers 15 and 16 are covered by two rocker covers 18 and 19 with bolts 17, respectively.

The feature of the ignition apparatus mounting structure of the present invention is to arrange each intake pipe 24A-1, 24A-2, 24A-3, 24B-1, 24B-2 or 24B-3 so as to extend above the cylinder head 10A or 10B and across the cylinder line and further be offset a little away from over the ignition plug hole 14 into which an ignition plug 45 is fitted, and closely beside the ignition coil 30A-1, 30A-2, 30A-3, 30B-1, 30B-2 or 30B-3, respectively In more detail, the intake pipes 24A-2, 24A-3 and 24B-1 and 24B-2 are arranged above and between the two adjacent ignition plug holes 14, and the other intake pipes 24A-1 and 24B-3 are arranged above and a little away from above the ignition plug holes 14 at the down stream end on the cylinder head 10A and the upper stream end on the cylinder head 10B along the cylinder line.

Further, with reference to FIG. 2 again, each ignition coil 30A-1, 30A-2 or 30B-2 (not shown), 30B-3 (not shown) is arranged between the two adjacent intake pipes 24A-1 and 24A-2, 24A-2 and 24A-3, or 24B-1 and 24B-2, or 24B-2 and 24B-3, respectively. On the other hand, each ignition coil 30A-3 or 30B-1 is arranged beside the intake pipe 24A-3 or 24B-1, respectively.

These ignition coils 30 are all arranged beside the intake pipes 24 but over the ignition plugs 45, respectively to supply a high tension to each ignition plug 45 at a shortest possible distance. Further, the ignition plugs 45 are connected to the ignition coils 30 via high tension adapter 40, respectively as follows:

The ignition coil 30 is composed of an iron core 32, a coil 33, a bracket 34, a primary voltage connector 35, and a secondary (high tension) voltage connector 36. The high tension adapter 40 is composed of a cap 41 fitted to the secondary voltage connector 36, an extension portion 42, and a bush 43 fitted to the ignition plug 45. Further, a protective cylindrical member 44 formed with a flange **44*a* is disposed to protect the outer periphery of the high tension adapter 40 from the cap 41 to the ignition plug 45, and the cap 41 is formed with a flange 41*a* so as to be brought into contact with the flange 44*a* of the protective cylindrical member 44, in order to prevent water or dust from entering the ignition plug 45. In assembly, the bush 43 is first fitted to the ignition plug 45 and then the adapter 40 is pushed toward the ignition coil 30 for connection of the adapter 40 with the ignition coil 30. Further, the flange 44*a* of the protective cylinder member 44 is fixed to the cylinder head 10A to fix the high tension adapter 40**.

On the other hand, the bracket 34 of the ignition coil 30 is formed with bolt holes. Two coil supports members 26 are formed on the outer side surfaces of each intake pipe 24. In this embodiment, with reference to FIG. 2 again, an arm 28A extends from the air collector 22A on the upper stream side of the air collector 22A to form a similar coil support member 26 thereon, and another arm 28B extends from the air collector 22B on the down stream side of the air collector 22B to form a similar coil support member 26 thereon. Therefore, the ignition coils 30 are all fixed to the coil support members 26 formed on the two adjacent intake pipes 24A-1 and 24A-2, 24A-2 and 24A-3, 24B-1 and 24B-2, 24B-2 and 24B-3 or formed on the intake pipe 24A-3 and the arm 28A or the arm 28B and the intake pipe 24B-1 by screwing bolts 29 into the bolt holes formed in the brackets 34 of the ignition coils 30 and the coil support members 26 of the intake pipes 24 or the arms 28.

In the ignition apparatus mounting structure for an internal combustion engine according to the present invention, since the intake pipes 24A-1, 2, 3 24B-1, 2, 3 branched from the collectors 22A and 22B are arranged so as to extend above the cylinder head 10A or 10B and across the cylinder line and further be offset away from over the ignition plugs 45 and further since the ignition coils 30A-1, 2, 3 and 30B-1, 2 3 connected to the ignition plugs 45 are supported by two support members formed on the two adjacent intake pipes 24A, respectively, it is possible to readily remove the ignition coils 30 and the ignition plugs 45 from between the two adjacent intake pipes 24 without removing the intake pipes 24.

In addition, since the ignition coils 30 are supported between two side surfaces of two adjacent intake pipes 24 via two support members 26, heat transmitted from the cylinder head 10 is not directly transmitted to the ignition coils 30. Further, since the ignition coils 30 are arranged being exposed to the outside, it is possible to effectively cool the ignition coils 30 or to prevent high tension generated by the ignition coils 30 from being dropped.

Therefore, it is possible to improve the inspection work efficiency for the ignition coils 30 and the ignition plugs 45 and the performance of the ignition coils 30 without reducing the high tension generated by the ignition coils 30.

What is claimed is:

1. An ignition apparatus mounting structure for an internal combustion engine having at least one cylinder head formed with a plurality of engine cylinders; a plurality of ignition plugs provided for the engine cylinders, respectively; a plurality of ignition coils connected to the ignition plugs, respectively; and a plurality of intake pipes branched from at least one air collector and connected to the engine cylinders, respectively, wherein each of said intake pipes is arranged extending above said cylinder head and across a cylinder line and being offset away from and over each of said ignition plugs each of said ignition coils is arranged over and connected to one of said ignition plugs, and said intake pipes are formed with support members on side surfaces thereof to support at least one of said ignition coils between two support members opposingly formed on two adjacent intake pipes, respectively.

2. The ignition apparatus mounting structure of claim 1, wherein two of said ignition coils located on the upper- and down-stream sides of the cylinder line are supported, respectively between two support members opposingly formed on one of two arm members extending from two air collectors respectively and on the outer side surface of one of said upper- and down-stream side intake pipes.

* * * * *